US005343644A

United States Patent [19]

Fleming

[11] Patent Number: 5,343,644

[45] Date of Patent: Sep. 6, 1994

[54] PLIABLE PIN STRIP

[76] Inventor: Ward Fleming, 1527 Manorville Rd., Saugerties, N.Y. 12477

[21] Appl. No.: 879,985

[22] Filed: May 8, 1992

[51] Int. Cl.[5] ..... G09F 19/00

[52] U.S. Cl. ..... 40/446

[58] Field of Search ..... 5/933, 564; 411/442, 411/443, 444; 206/338, 345, 346, 347; 15/240, 186, 187, 188; 40/446

[56] References Cited

U.S. PATENT DOCUMENTS 152,735 7/1874 Fischer ..... 411/444

3,739,419 6/1973 Natman et al. ..... 15/187

FOREIGN PATENT DOCUMENTS 622532 5/1949 United Kingdom ..... 15/186

*Primary Examiner*—Kenneth J. Dorner

*Assistant Examiner*—Cassandra Davis

*Attorney, Agent, or Firm*—Howard C. Miskin

[57] ABSTRACT

A display device includes a highly pliable web having an array of longitudinally and transversely pins mounted on a face of the web, the pins having shanks projecting upwardly perpendicular to the area of the web at which the respective pin shanks are located. A shaping member has a contoured pressed against the underface of the web to recoverably deform the web and vary the pin shank orientations. Different webs and pin anchoring constructions are described.

6 Claims, 9 Drawing Sheets

PLIABLE PIN STRIP

BACKGROUND OF THE INVENTION

The present invention relates generally to improvements in display devices and it relates particularly to an improved display device of the three dimensional contour actuated type.

A three dimensional contour actuated type of display device is known and has been described in which an array of closely spaced rows and columns of headed pins are slidably supported by a pair of parallel apertured plates traversed by the pins. The device is applied to a three dimensional, contoured actuating surface which longitudinally shifts the pins so that their free headed ends delineate a surface corresponding to that of the contoured surface, the pins being always mutually parallel. While such a device presents an attractive display, such display is relatively static, merely being an image of the actuating contoured surface. Moreover, such devices are expensive and bulky, often unreliable, of little versatility and adaptability and otherwise leave much to be desired.

SUMMARY OF THE INVENTION

It is a principal object of the present invention to provide an improved display device.

Another object of the present invention is to provide an improved mechanical dynamic display device of the pin screen type.

A further object of the present invention is to provide an improved pin screen display device whose presentation is dynamic and provides a uniquely dynamic image which may be easily and quickly varied and adjusted.

Still a further object of the present invention is to provide an improved display device of the above nature characterized by its attractive and unique dynamic presentation and by its great versatility and adaptability.

The above and other objects of the present invention will become apparent from a reading of the following description taken in conjunction with the accompanying drawings which illustrate preferred embodiments thereof.

A display device in accordance with the present invention comprises a normal planar, pliable web deformable by the pressure of a contoured surface to its inner face to correspondingly deform the opposite outer face of the web and an array of closely longitudinally and transversely spaced pins having enlarged heads anchored to the webs and elongated shanks perpendicular to the web outer surface. The contoured face may be the face of a shaping member located proximate the pliable web with the contoured face confronting and engaging the web inner face, with the web and shaping member being relatively movable. Advantageously, the shanks are between $\frac{1}{4}$ inch and 2 inches in length.

The web may be a woven or non-woven fibrous web or a thermoplastic polymeric resin pellicle or sheet and the heads of the pins have their end faces cemented to the web with any suitable glue or the heads may be embedded in the thermoplastic web. A second web may overlie the first web and have approximately equally dimensioned and spaced apertures pierced by the pin shanks. In the operation of the improved display device, the pin shanks are not only longitudinally displaced but also angularly varied by the deformation of the web by the shaping member contour face, the shanks of the individual pins being perpendicular to the web outer face. The positions and orientations of the pin shanks change with the longitudinal advance across the shaping member contoured face presenting a highly attractive dynamic image. Alternatively, the shanks may be integrally formed with the pliable web, being molded of a synthetic organic plastic polymer.

The improved display device is rugged and simple, easy and convenient to operate, of great versatility and adaptability and presents a unique and attractive display.

BRIEF DESCRIPTION OF THROWINGS

DESCRIPTION OF THE PREFERRED EMBODIMENTS

Figure 1:
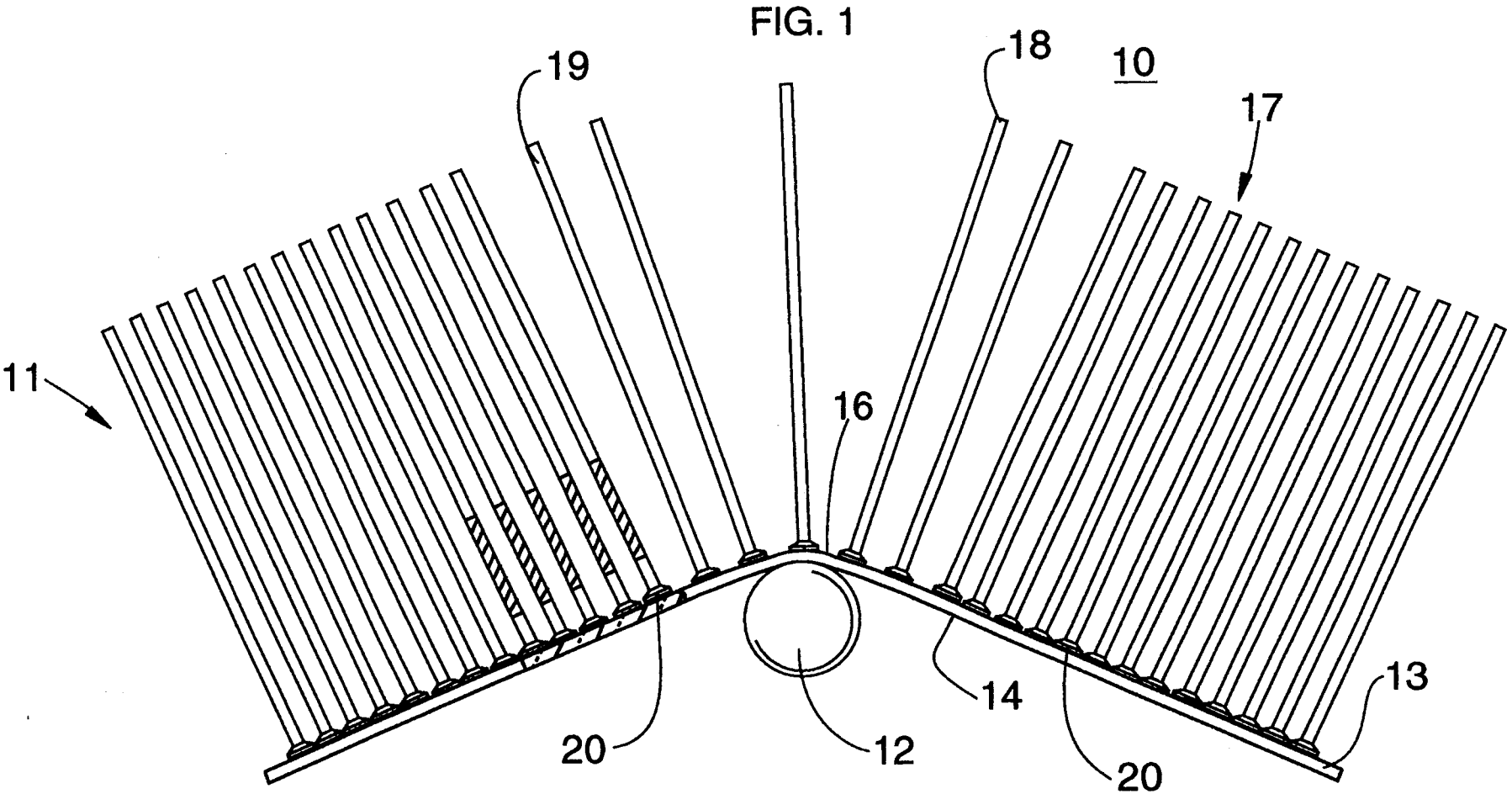
FIG. 1 is a side elevational view partially in section, of a preferred embodiment of the present invention, the display device being shown in an operating condition.
Figure 2:
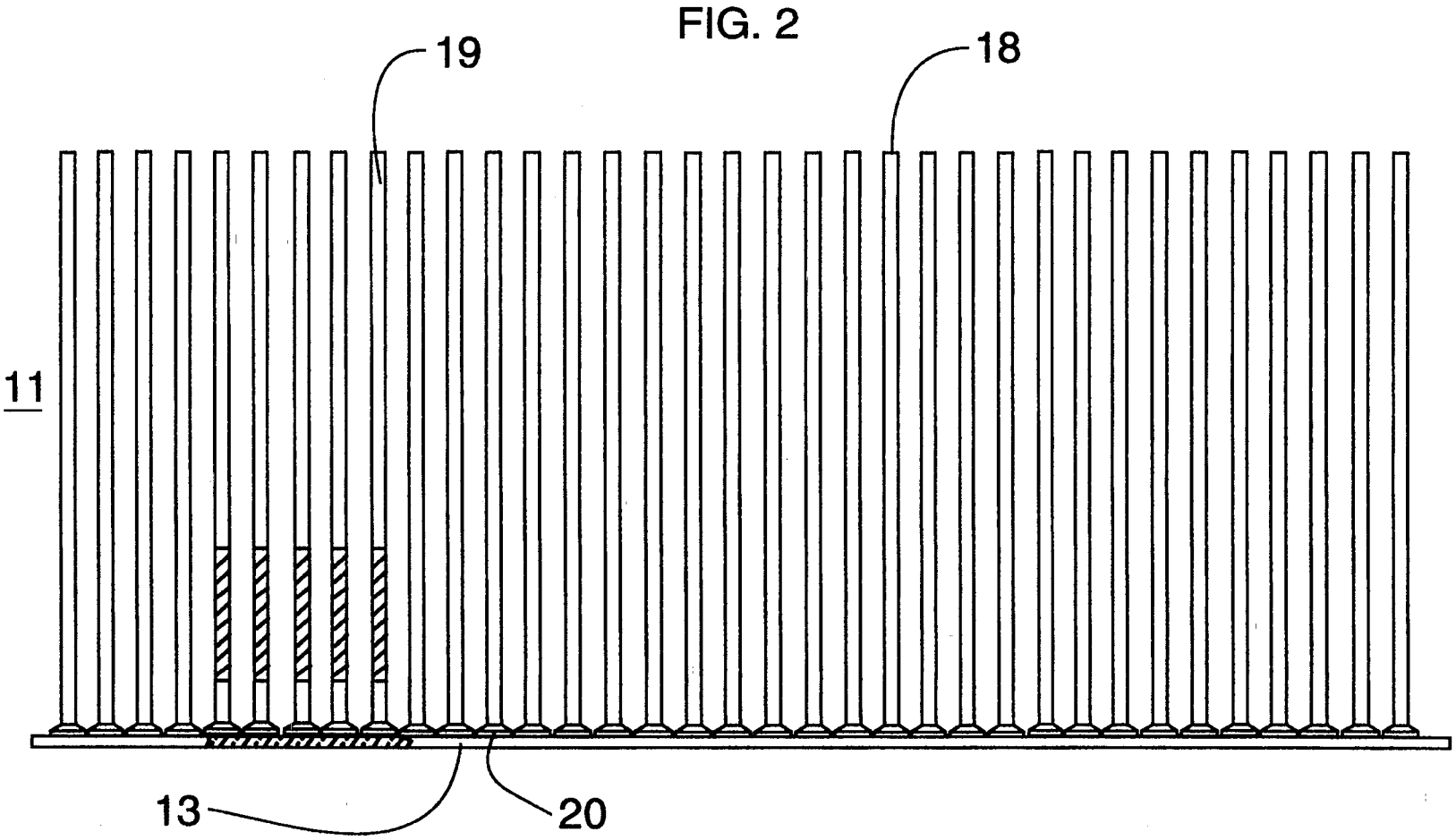
FIG. 2 is a side elevational view of the pin carrying member of the device shown in FIG. 1.
Figure 3:
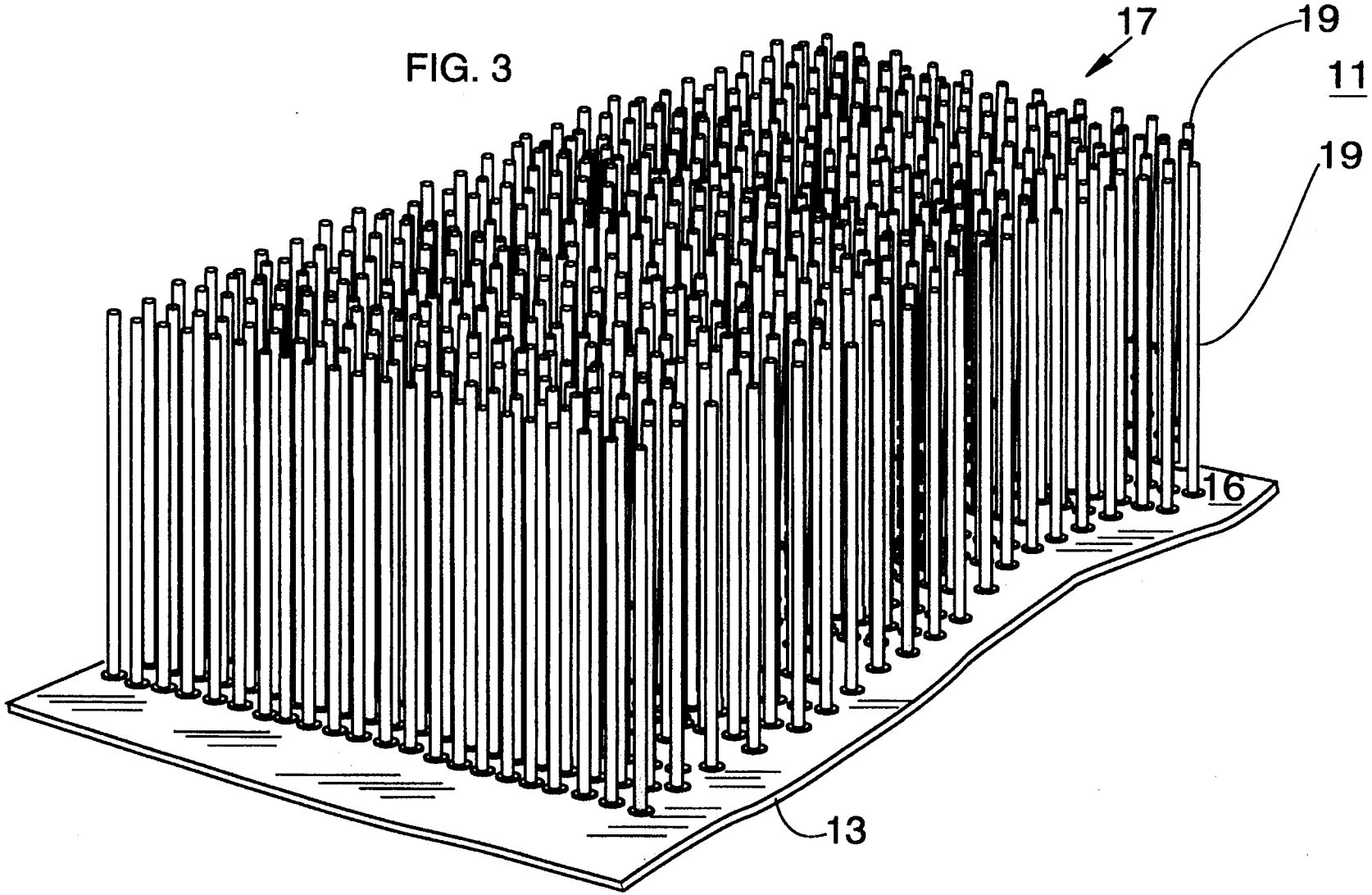
FIG. 3 is an end perspective view thereof.

Referring now to the drawings, particularly FIGS. 1 to 3 thereof which illustrate a preferred embodiment of the present invention, the reference numeral 10 generally designates the improved display device which includes an image display pin strip member 11 and a contoured shaping member 12. The shaping member may be stationary or rotate or otherwise move relative to pin strip member 11 and while illustrated as a smooth surfaced circular cylinder, it may have a face of varying configuration and may be otherwise shaped.

Pin strip member 11 includes a highly pliable, flexible thin base web or strip 13 which may be formed of a woven or non-woven fibrous fabric or a thermoplastic organic polymer resin pellicle or sheet or other highly flexible pliable web which may be rapidly deformed by pressure applied to an outer face 14 thereof, the outer or inner face 16 being correspondingly deformed.

An array or matrix 17 of closely longitudinally and transversely spaced pins 19 is mounted atop and firmly secured to web 13. Each pin 18 includes a straight shank 19 having formed at its bottom an enlarged circular head 20 with an approximately flat end face affixed to web inner face 14 with any suitable glue or cement and is so oriented that the respective pin shank is perpendicular to face 14. Thus, when web face 14 is planar and horizontal pin shanks 19 are parallel and vertical.

As web face 14 is deformed with web 13 by pressure applied by the contoured outer face of shaping member 12; web outer face 16 is correspondingly deformed and the orientations and positions of pin shanks 19 are altered as the shanks are perpendicular to the deformed face 16 of web 13. By moving web 13 and shaping member 12 longitudinally relative to each other the deformation of web face 14 moves longitudinally along web 13 providing a corresponding movement of the deformation induced orientation and position modification of the pin shanks 19 to present an attractive and dynamic presentation or image.

Figure 4:
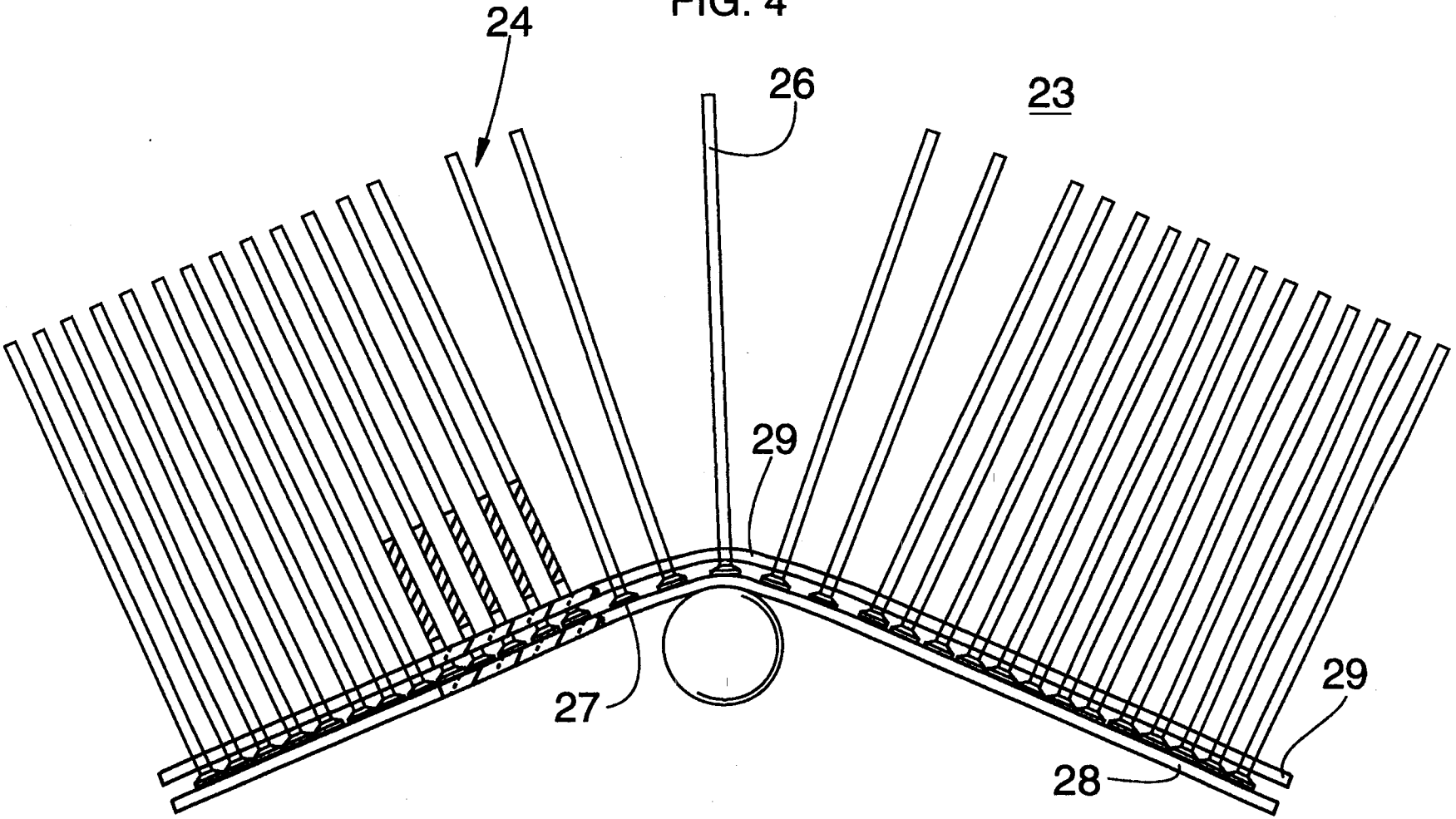
FIG. 4 is a view similar to FIG. 1 of another embodiment of the present invention.
Figure 5:
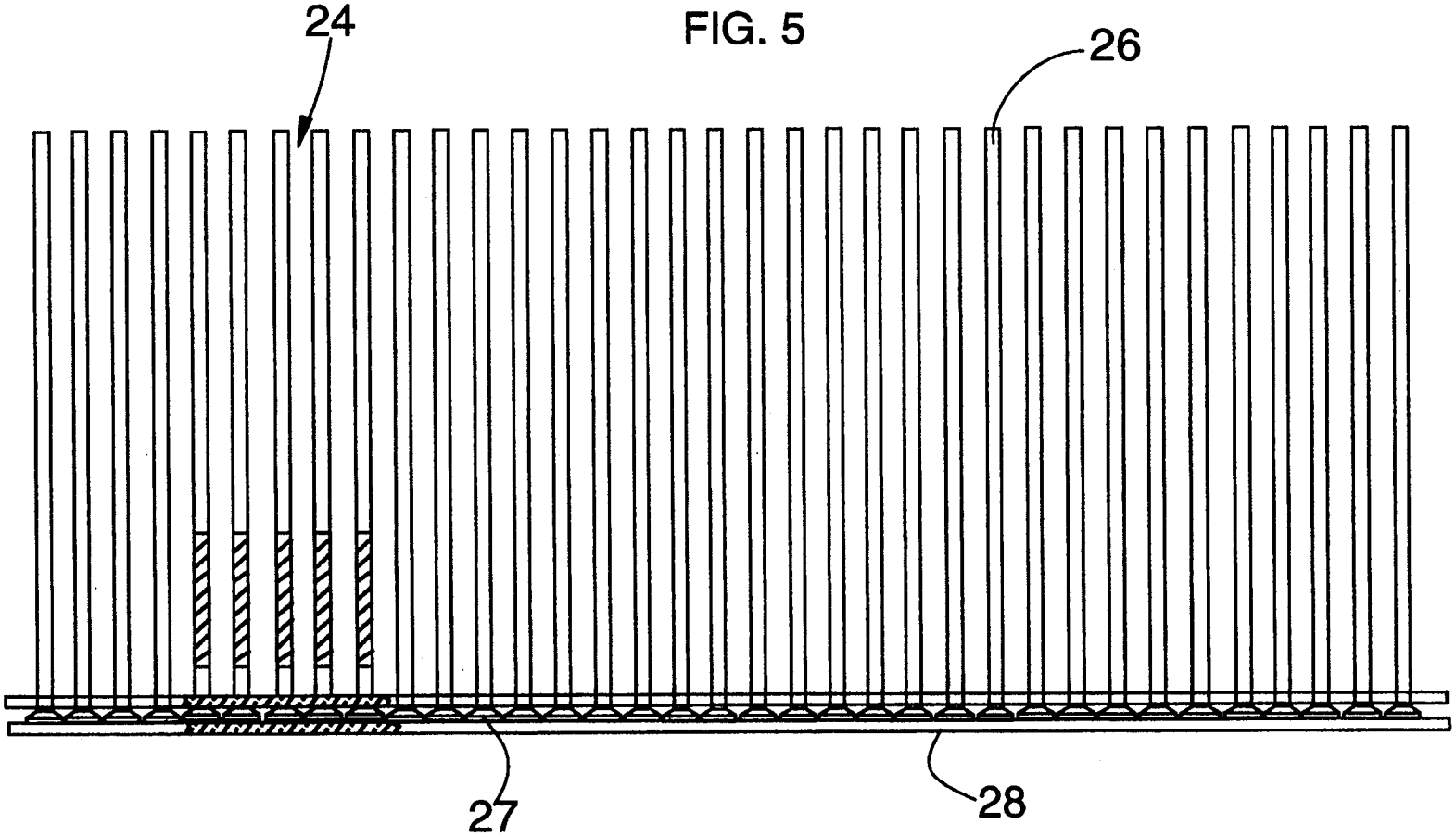
FIG. 5 is a view similar to FIG. 2 of the pin carrying member of the device shown in FIG. 4.

The embodiment of the invention shown in FIGS. 4 and 5 differs from the device first described primarily in the provision on an overlay web to reinforce the anchoring of the pins to the base web. Specifically, the modified device 23 includes an array of pins 24 which array is similar to the pin array 17 both in configuration and construction and includes pins having straight shanks 26 and enlarged bottom heads 27 glued or cemented to the inner or upper face of pliable web 28 similar to web 13. A reinforcing web 29 which may be formed of any suitable pliable material as that of web 13 has circular apertures formed therein of slightly larger diameter than that of pin shanks 26 overlies and is affixed to pin heads 27 and base web 28 in any suitable manner. In all other respects, the display device 23 is similar to the display device 11 and operates in a similar manner being provided with a contoured shaping member underlying and engaging base web 28.

Figure 6:
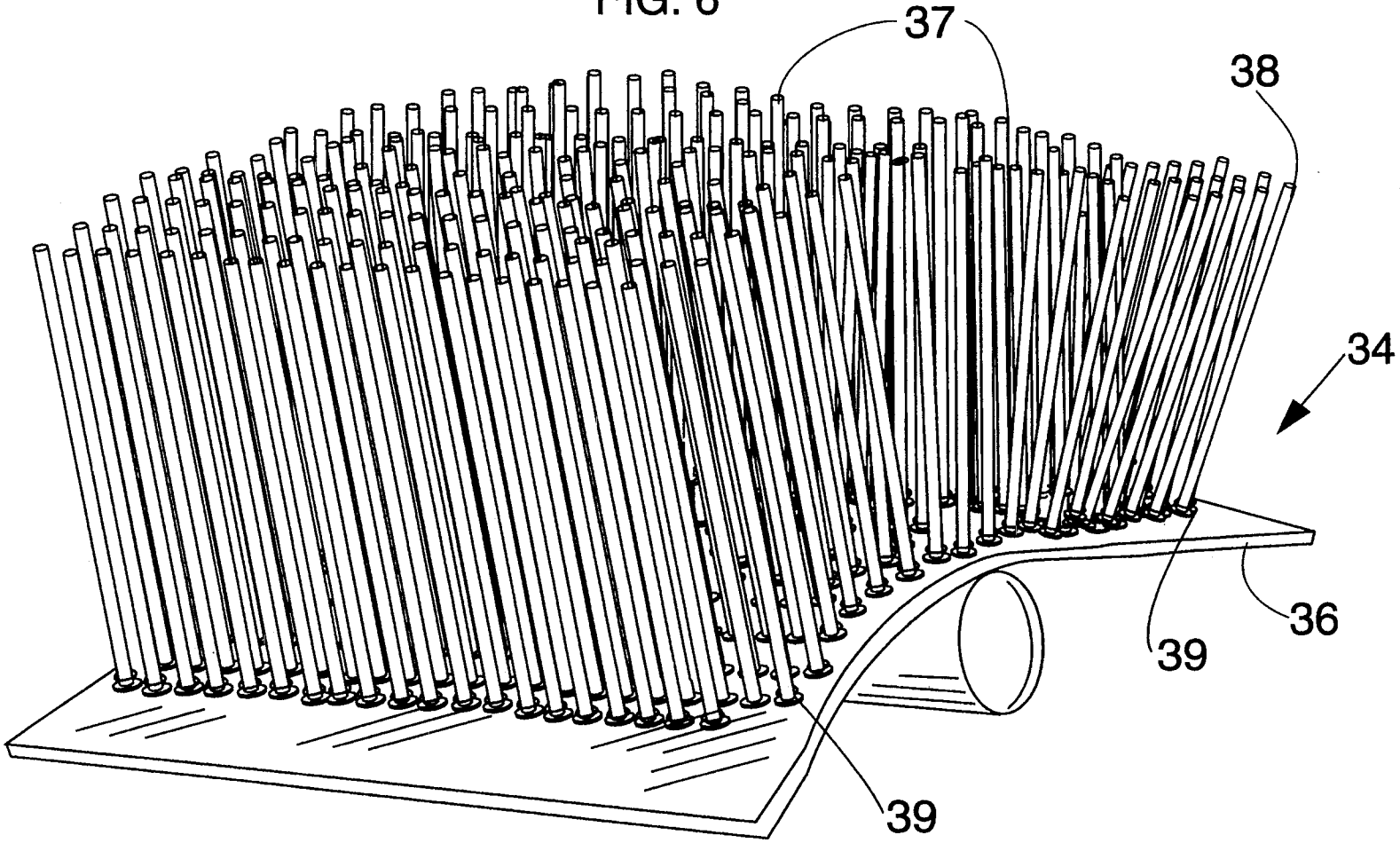
FIG. 6 is an end perspective view of a further embodiment of the present invention.

In FIG. 6 of the drawing, there is shown a modified pin strip 34 which differs from pin strip 11 and may be substituted therefor. The pin strip 34 includes a base web 36 which is a pliable sheet of a thermoplastic organic polymeric resin and an array of pins 37 which include elongate shanks 38 terminating at their bottoms in enlarged heads 39 which are embedded in sheet 36. The pin heads 39 may be embedded in sheet 36 by heating the sheet to its fusion or melting temperature and pressing the pin heads 38 into the softened or fluid sheet and thereafter cooling the sheet to thereby anchor the pins 37 to the web 36. In all other respects, construction and operation, the last described display device is similar to those earlier described.

Figure 7:
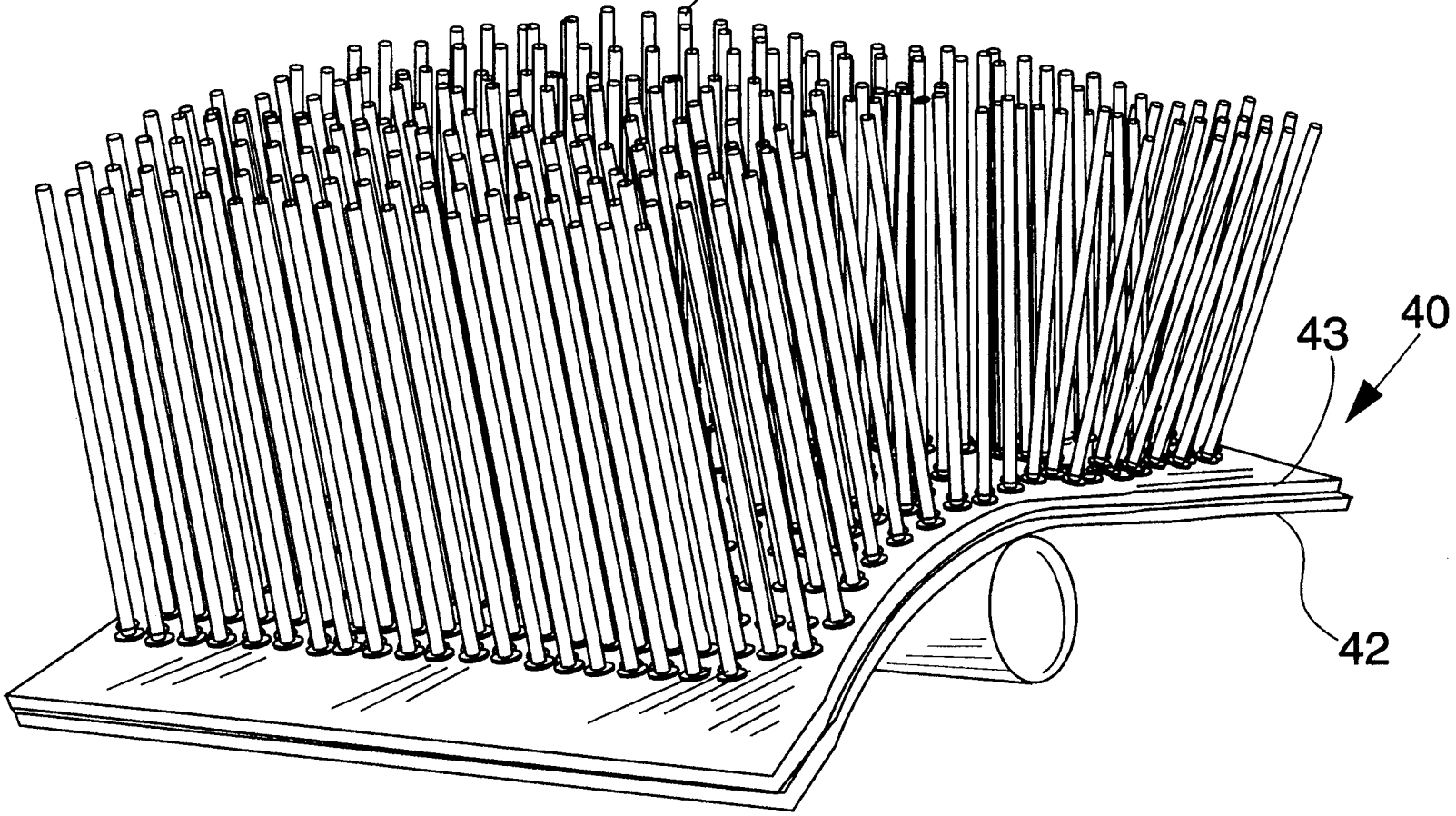
FIG. 7 is an end perspective view of a modified form of the display device shown in FIGS. 4 and 5.
Figure 8:
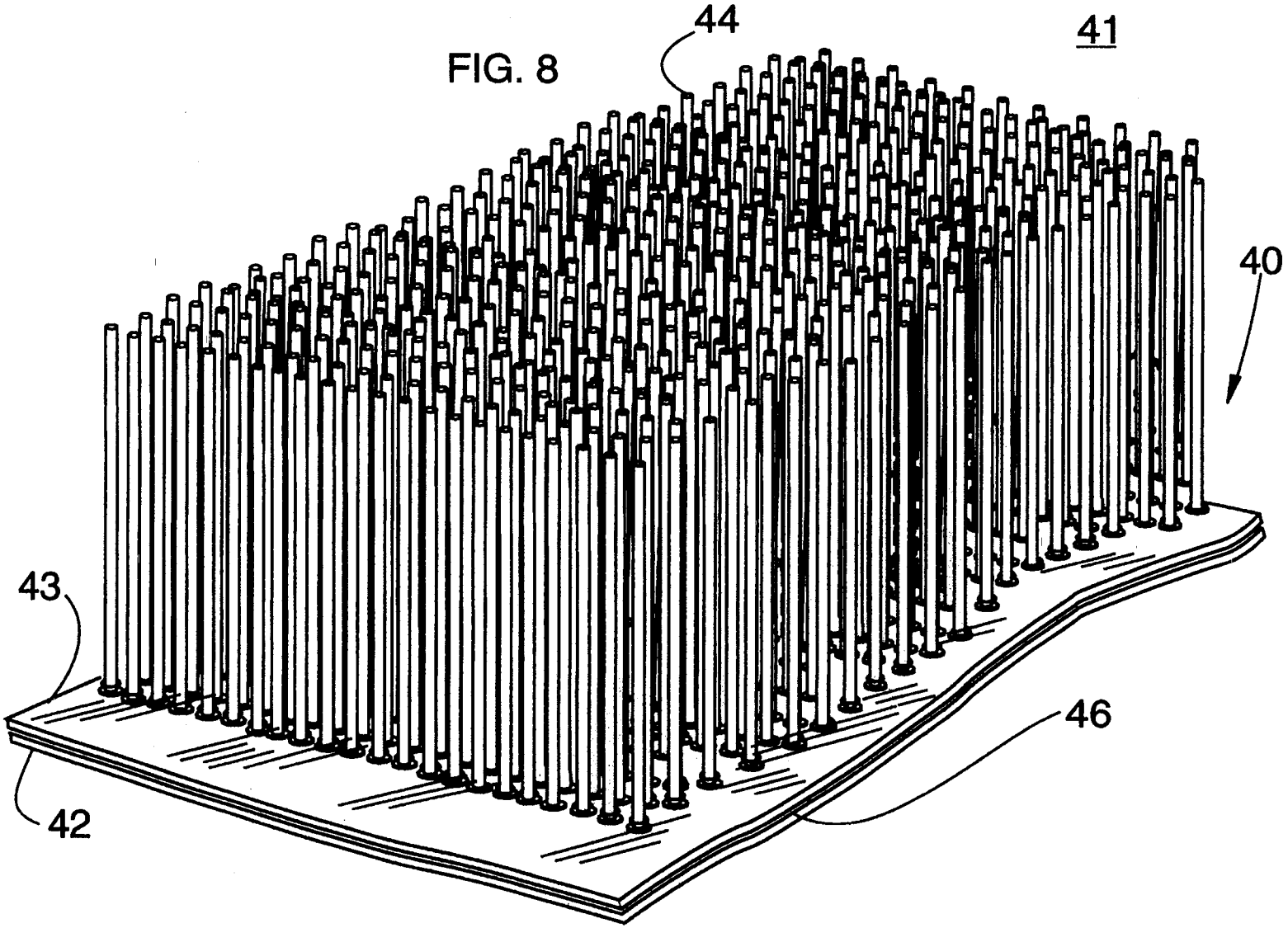
FIG. 8 is an end perspective view of the pin carrying web of the device shown in FIG. 7.

The device shown in FIGS. 7 and 8 differs from that shown in FIGS. 4 and 5 in that the pin support strip includes a base web and an anchor web which are mutually cemented at their confronting faces and sandwich the pin heads between them. Specifically, the pin carrying web 40 of the modified pin strip 41 includes a pliable base web 42 and an overlying locking web 43. The locking web 43 has apertures formed therein of lesser diameter than the pin heads and being pierced by the pin shanks 44. The webs 42 and 43 tightly sandwich between them the pinheads ad the webs 42 and 43 are mutually cemented by a layer of a suitable glue 46 at the interface of the webs so as to firmly anchor the pins to web 40 with the pin shanks being perpendicular to the web surface in the area of the respective pin. The pin strip 41 and the associated components of the display device are of a construction similar to and operate in the manner of the display device 10 except as specified above.

Figure 9:
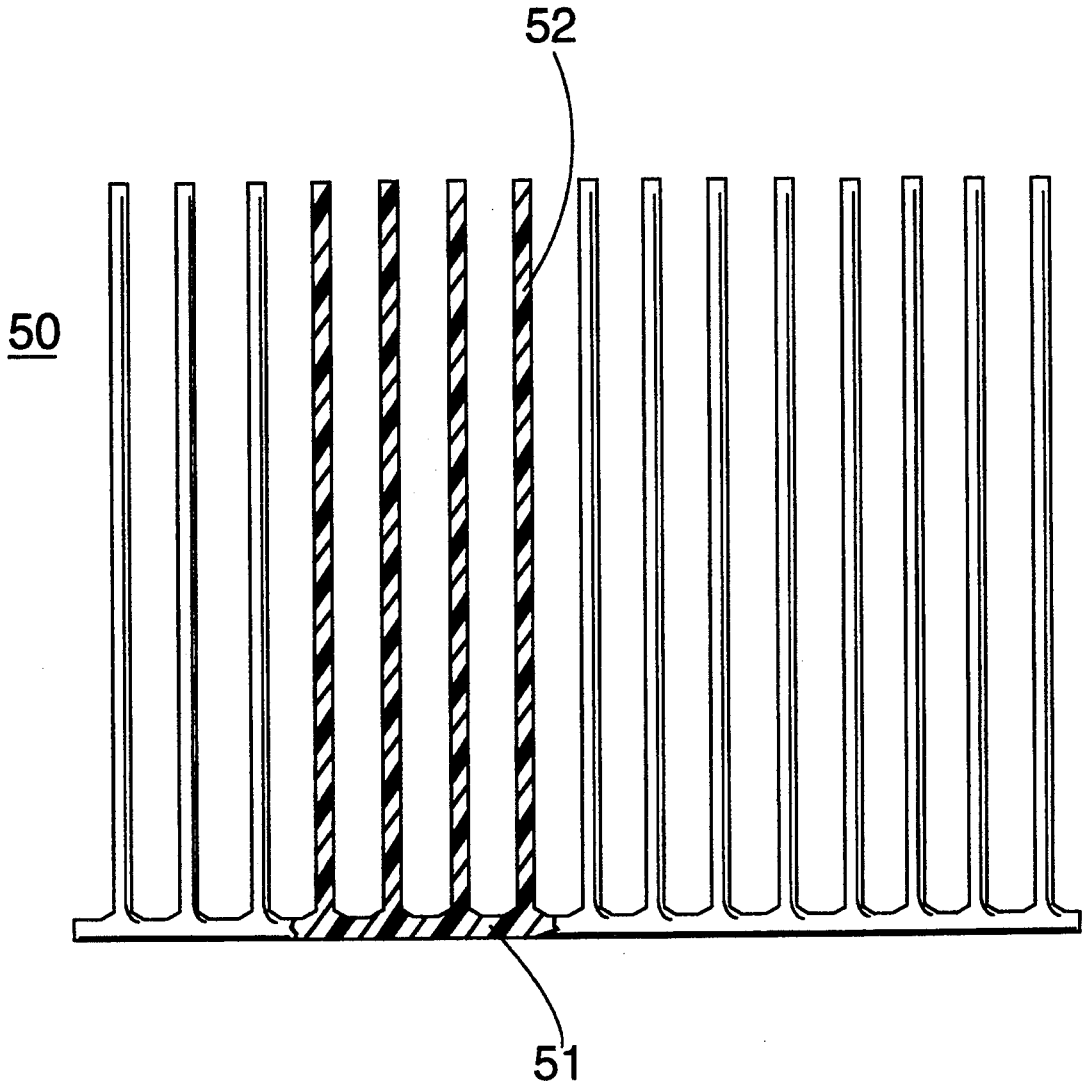
FIG. 9 is a modified pin strip shown in fragmented section which may be substituted for any of the pin strips illustrated above.

Referring now to FIG. 9 of the drawings which illustrates a modified pin strip 50 which may be substituted for any of the pin strips employed in any of the display devices described above, specifically, the pin strip 50 includes a longitudinally extending pliable flexible web or pellicle 51 formed of a thermoplastic synthetic organic polymeric resin. Integrally formed with pellicle 51 is an array or matrix of longitudinally and transversely spaced thin vertical shanks 52 projecting upwardly from and perpendicular to the top face of web 51. The shanks 52 are in the form of cylindrical rods tapering outwardly at the joining to the web 51 and formed of the same material as web 51. In all other respects, the construction and operation of the display device employing the pin strip 50 is similar to that of any of the improved display devices described above.

While there have been described and illustrated preferred embodiments of the present invention, it is apparent that numerous alteration, omissions and additions may be made without departing from the spirit thereof.

I claim:

1. A display device comprising a pliable first web having opposite inner and outer faces and responsive to deformation of said inner face to correspondingly deform said outer face, and array of closely spaced pins carried by said web, each of said pins including an enlarged head anchored to said web and an elongated shank projecting outwardly from said outer face perpendicular to said outer face adjacent to said respective pin head and shaping means for applying pressure to said web inner face varying in amount and direction to form said web to a predetermined contour.

2. The display device of claim 1 wherein said shaping means comprising a shaping member having a contoured face engaging said web inner face.

3. The display device of claim 2 wherein said web and said shaping member are relatively longitudinally movable.

4. The display device o claim 1 wherein the heads of said pins have outer end faces and are anchored to said web by an adhesive between said outer end faces of said pins and said web outer face.

5. The display device of claim 1 wherein said web is formed of a thermoplastic polymeric resin and said heads of said pins are embedded in said web.

6. The display device of claim 1 comprising a pliable second web overlying said first web and said heads of said pins and adherent to said first web and having apertures traversed by said pin shanks.

* * * * *